US010888873B2

(12) United States Patent
Viitala et al.

(10) Patent No.: US 10,888,873 B2
(45) Date of Patent: Jan. 12, 2021

(54) COMPACT NOISE ENCAPSULATION FOR MOBILE PROCESSING DEVICES

(71) Applicant: Metso Minerals, Inc., Helsinki (FI)

(72) Inventors: Jyrki Viitala, Nokia (FI); Tuomas Tuokko, Tampere (FI); Mikko Takaniemi, Valkeakoski (FI); Juhamatti Heikkilä, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 218 days.

(21) Appl. No.: 16/087,303

(22) PCT Filed: Mar. 21, 2017

(86) PCT No.: PCT/EP2017/056649
§ 371 (c)(1),
(2) Date: Sep. 21, 2018

(87) PCT Pub. No.: WO2017/162642
PCT Pub. Date: Sep. 28, 2017

(65) Prior Publication Data

US 2019/0105663 A1 Apr. 11, 2019

(30) Foreign Application Priority Data

Mar. 24, 2016 (EP) ..... 16162241

(51) Int. Cl.
*B02C 21/02* (2006.01)
*B07B 1/00* (2006.01)
(Continued)

(52) U.S. Cl.
CPC ..... *B02C 21/026* (2013.01); *B02C 13/282* (2013.01); *B02C 21/02* (2013.01);
(Continued)

(58) Field of Classification Search
CPC ..... B02C 21/02; B02C 13/282; G10K 11/16; G10K 11/36; B07B 1/005
(Continued)

(56) References Cited

U.S. PATENT DOCUMENTS 3,895,761 A * 7/1975 Mills ..... B02C 23/02 241/301
3,951,245 A * 4/1976 Hench, Sr. ..... B29B 9/06 193/32
(Continued)

FOREIGN PATENT DOCUMENTS

CN 201684645 U 12/2010
DE 44 43 231 A1 6/1995
(Continued)

OTHER PUBLICATIONS

International Search Report and Written Opinion for International Application No. PCT/EP2017/056649 dated Apr. 21, 2017.
(Continued)

*Primary Examiner* — Faye Francis
(74) *Attorney, Agent, or Firm* — Andrus Intellectual Property Law, LLP

(57) ABSTRACT

The invention concerns a mobile processing device having a material processing unit, such as a mobile crusher having a crusher unit or a mobile screen having a material screening unit. The mobile processing device comprises a power unit, a frame and a noise encapsulation for the material processing unit. The noise encapsulation is attached to the frame and comprises two cover elements, each of which is pivotable between an open position providing access to the crusher unit and a closed position wherein the cover elements can be interconnected to create an encapsulation for the material processing unit.

14 Claims, 4 Drawing Sheets

(51) Int. Cl.
*B02C 13/282* (2006.01)
*B07B 13/14* (2006.01)
*G10K 11/16* (2006.01)

(52) U.S. Cl.
CPC ..... *B07B 1/005* (2013.01); *B07B 13/14* (2013.01); *G10K 11/16* (2013.01)

(58) Field of Classification Search
USPC ..... 241/101.74, 285.2
See application file for complete search history.

(56) References Cited

U.S. PATENT DOCUMENTS 4,061,282 A 12/1977 Walker et al.
4,129,264 A * 12/1978 Lanin ..... B02C 23/02 181/200
4,371,120 A * 2/1983 Grapin ..... B02C 17/22 241/182
4,883,144 A * 11/1989 Haushalter ..... A47J 43/07 181/198
5,203,052 A * 4/1993 Hardy ..... D01G 9/08 181/200
5,272,285 A * 12/1993 Miller ..... F04B 39/0033 181/202
5,746,377 A 5/1998 Gehrig
5,957,577 A * 9/1999 Dickson ..... A47J 43/07 366/197
6,571,908 B2 * 6/2003 Bohannon ..... A47J 43/0716 160/201
7,293,727 B2 * 11/2007 Moriya ..... B02C 13/095 241/101.74
7,648,091 B2 * 1/2010 Umeda ..... B02C 18/067 241/101.74
8,087,603 B2 * 1/2012 Kolar ..... A47J 43/0716 241/285.3
8,287,180 B2 * 10/2012 Kolar ..... A47J 43/0716 366/347
8,752,481 B2 * 6/2014 Williams ..... A47J 43/085 366/197
8,888,029 B2 * 11/2014 Black ..... B02C 23/00 241/152.1
RE45,308 E * 12/2014 Kolar ..... A47J 43/0716 366/347
RE45,655 E * 8/2015 Kolar ..... A47J 43/0716
10,376,102 B2 * 8/2019 Bock ..... A47J 43/046
10,383,481 B2 * 8/2019 Kim ..... A47J 43/046
2013/0099033 A1 * 4/2013 Black ..... B02C 21/00 241/30

FOREIGN PATENT DOCUMENTS

GB 2464372 B8 7/2012
JP 2009226294 A 10/2009
JP 5053707 B2 10/2012
WO 2009156454 A1 12/2009

OTHER PUBLICATIONS

Office Action for corresponding Chinese Patent Application No. 2017800199036 dated Nov. 27, 2020.

* cited by examiner

COMPACT NOISE ENCAPSULATION FOR MOBILE PROCESSING DEVICES

CROSS-REFERENCE TO RELATED APPLICATIONS

This application claims priority to PCT/EP2017/056649, filed Mar. 21, 2017, and published in English on Sep. 28, 2017 as publication number WO 2017/162642, which claims priority to European Application No. 16162241.0, filed Mar. 24, 2016, incorporated herein by reference.

FIELD OF THE INVENTION

The present invention relates to a crushing device, especially a mobile crusher having for example a jaw, impact or cone crusher unit. Further, the invention is also applicable to mobile screens.

BACKGROUND OF THE INVENTION

When crushing or grinding rock, ore, gravel, cement clinker, garbage and other materials, mobile, possibly self-propelled crushers may be used. There are different types of crusher units used in such mobile crushers; jaw crushers, impact crushers and cone crushers are some examples thereof. These types of mobile crushers are not exclusively used in remote uninhabited areas, sometimes they are used in urban areas where noise dampening and dust reduction are of high importance and therefore noise dampening and dust reducing measures are sometimes required. Typically, these mobile crushers functions as follows: Material, e.g. rocks, gravel, construction waste, garbage etc, to be treated by the mobile crusher is loaded to an upstream end of the crusher, the crusher's feed hopper. From there, the material is fed to the crusher unit, e.g. a jaw crusher or an impact crusher, where the material is disintegrated. If needed, parts of the material, often fine fractions that don't need to pass the crusher unit, can be directed directly from the feed hopper to a side conveyor that transports this material away. Material treated by the crusher unit is typically conveyed for further treatment, e.g. by a mobile screening unit, where similar problems occur since these devices, e.g. mobile screens also are rather noisy which especially in inhabited areas can be a problem. A known crushing device providing a certain extent of encapsulation is disclosed in JP-5053707.

SUMMARY OF THE INVENTION

It is an object of the invention to provide a mobile processing device which overcomes, or at least reduces, problems occurring in previously known solutions, and ensures a simple and reliable noise encapsulation which, in a closed position reduces the noise emitted to the environment and which, in an open position provides good access to the machinery for service and maintenance.

According to the invention, these and other objects are achieved, in full or at least in part, by a mobile processing device as disclosed. The mobile processing device comprises a material processing unit and a frame to which a pivotable noise encapsulation is attached.

Thus, in accordance with the present invention, there is provided a mobile processing device having a material processing unit, such as a mobile crusher having a crusher unit or a mobile screen having a material screening unit. The mobile processing device further comprises a power unit such as an internal combustion engine, an electric motor or any other suitable power plant for the mobile processing device. The mobile processing device comprises a frame and a noise encapsulation for the material processing unit. The noise encapsulation is attached to the frame of the mobile processing device and comprises two cover elements, each of which is pivotable between an open position, in which access to the machinery, e.g. the crusher unit or the screening unit, is provided, and a closed position where excellent noise dampening is ensured. The cover elements can be interconnected to create an encapsulation for the material processing unit having a roof and side walls. By providing two pivotable cover elements encapsulating the material processing unit, such as a crusher unit of a mobile crusher or a screening unit of a mobile screen, by providing side walls and roof it is possible achieve excellent noise dampening properties while still ensuring that the machinery, e.g. crusher unit of a mobile crusher, can be readily accessed for service and maintenance. Prior art noise dampening constructions all have the disadvantage that a large number of hatches or doors need to be removed, often even dismantled, in order to provide access to the machinery. The noise encapsulation according to the invention, on the other hand, provides excellent maintenance conditions for staff working on the machine and this despite the compact size of the encapsulation. Further, the fact that the noise encapsulation is attached to the frame of the mobile processing device makes it possible for the noise encapsulation to be transported together with the mobile processing device and no additional resources (e.g. lorries, train wagons etc) are required for its transportation to the work site. In comparison with solutions where the noise encapsulation need to be separately transported and subsequently assembled in situ, the solution according to the invention saves money and time. With the present invention, the mobile processing device can be unloaded from e.g. a lorry trailer and be up and running within the shortest time. This especially applies when the mobile processing device is of the self-propelled type, running e.g. on crawlers which makes it possible for the mobile processing device to reach a final working location independently. The noise level reduction obtained with the encapsulation is significant and especially in urban areas where the background noise level typically is elevated due to traffic noise and in many cases also other construction machinery (drilling machinery, excavators etc.) is operating at the construction site, the contribution of noise of a mobile processing device according to the invention is neglectable, or at least reduced to a large extent. Further, the noise encapsulation according to the present invention prevents or reduces dust emissions from the material processing unit and the discharge area. In addition to environmental benefits, this also extends lifetime of air filters, e.g. for the engine and other parts of the equipment.

According to this first aspect the mobile processing device is a mobile crusher having a crusher unit.

The mobile processing device comprises a crusher cavity cover element. A crusher cavity cover element covers the entrance into the crusher cavity and can provide protection against particles (rocks, gravel etc.) flying out of the crusher cavity and can also provide noise encapsulation against noise coming directly from the crusher cavity.

The crusher cavity cover element is further pivotable around a generally horizontal axis between an open position in which access is provided to the crusher cavity and a closed position. A pivotable solution enables quick access to the crusher cavity, for example in order to be able to remove oversize rocks or similar that are trapped in the crusher.

In one embodiment of the first aspect, the crusher cavity cover element comprises a sealing part which, when the crusher cavity cover element is pivoted towards the closed position, seals against the roof of the encapsulation. A sealing according to this embodiment ensures reliable and secure sealing of the crusher cavity cover element against the pivotable cover element. A good sealing is a requirement for achieving good noise dampening properties.

In one of the embodiments of this first aspect, the mobile processing device further comprises a material screening unit.

Also disclosed is a second aspect, in which the mobile material processing unit is a mobile screen having a material screening unit, with a power unit; a frame, and a noise encapsulation for the material processing unit; wherein the noise encapsulation comprises two cover elements, each of said cover elements being pivotable between an open position providing access to the material processing unit and a closed position wherein the cover elements can be interconnected to create an encapsulation for the material processing unit, said encapsulation having a roof and side walls.

In one of the embodiments of first or second aspect, the noise encapsulation comprises a sub-frame connected to the frame of the mobile processing device.

In one of the embodiments of first or second aspect, the sub-frame is connected to the frame of the mobile processing device either directly or via vibration dampening material. Both have their advantages and drawbacks. By providing vibration dampening material, vibration of the sub-frame and thus the noise encapsulation can be reduced. Vibration of the noise encapsulation will cause the noise encapsulation to emit noise itself, and should therefore be avoided. On the other hand, the provision of vibration dampening material will allow a certain play between adjacent parts, i.e. frame of the mobile processing device and the sub frame. If such play becomes too big, one risks the situation where the noise encapsulation comes into direct contact with e.g. a crusher unit of a mobile crusher. That would cause the noise encapsulation to behave more or less like a loudspeaker, which of course is highly unwanted. Since the material processing unit, e.g. a crusher unit typically is suspended in rubber brackets as well, the total available play should be considered to avoid that the noise encapsulation comes in contact with the noise emitting equipment, such as crusher unit or screening unit.

In one of the embodiments of first or second aspect, the two cover elements are hinged at respective vertical beams.

In one of the embodiments of first or second aspect, the vertical beams are parts of the sub-frame.

In one of the embodiments of first or second aspect, each of the cover elements comprises a sidewall and a roof part and wherein, in the closed position, the respective roof parts abut each other and can be interconnected by locking means.

In one of the embodiments of first or second aspect, each cover element has a height such that it covers the height of the material processing unit when the cover elements are in the closed position. By providing cover elements which in the closed position cover the entire height of the material processing unit it is possible to provide full access to the material processing unit when the cover elements are in the open position. The pivotable cover elements of the invention also give very quick, almost instant, access to the machinery since they need only be swung open and it is not necessary to dismantle several doors or hatches attached by bolting or similar time consuming means as is the case in prior art solutions.

In one of the embodiments of first or second aspect, the sealing part seals against an underside of the roof.

In one of the embodiments of first or second aspect, the cover elements are attached to a wider section of the sub-frame and wherein the sub-frame has a narrower section adjoining the wider section. This creates a sort of corner-shaped space adjoining both the wider and narrower sections in which space equipment can be arranged which do not necessarily add to the overall width of the mobile processing device.

In one of the embodiments of first or second aspect, parts of the sub-frame section are arranged generally in a same vertical plane as vertically adjacent parts of the frame of the mobile processing device.

In one of the embodiments of first or second aspect, parts of the sub-frame section and the vertically adjacent parts of the frame of the mobile processing device have corresponding shapes and are arranged abutting each other to create a continuous vertical surface. This makes it possible to use the frame of the mobile processing device and the sub-frame as encapsulation parts, both against noise and dust which reduces the requirement of additional encapsulation elements. The frame and the subframe as such can be used for encapsulation purposes and large frame blocks can both isolate the airborne noise and also be used for installation of acoustic materials such as absorption materials. This reduces the cost of the encapsulation significantly.

In one of the embodiments of first or second aspect, a working platform is arranged laterally and outside the narrower sub-frame section and rearwardly of the wider sub-frame section. A working platform is normally required and by the inventive solution of the present invention, it is possible to attach a platform outside of the noise encapsulation, i.e. it is now possible to both have noise encapsulation and an accessible working platform mounted at the same time.

In one of the embodiments of first or second aspect, a hydraulic hammer is attached to the frame of the mobile processing device and arranged laterally and outside the narrower sub-frame section and rearwardly of the wider sub-frame section. Especially in a mobile crusher, it is of utmost importance to have access to a hydraulic hammer, e.g. for clearing rocks or similar that have become jammed in the crusher cavity or in the feed hopper. With the solution of the present invention, it is possible to combine noise encapsulation with a hydraulic hammer arranged at a convenient position, close to the crusher unit such that the articulated arm of the hydraulic hammer does not need to be overly lengthy. Instead, by providing a narrower section in the encapsulation, the hydraulic hammer can be arranged at a same position as in mobile crushers lacking noise encapsulation. And in combination with the pivotable crusher cavity cover element, the hydraulic hammer has very quick access to the crusher cavity.

In one of the embodiments of first or second aspect, the hydraulic hammer and the working platform are arranged opposite each other.

In one of the embodiments of first or second aspect, the working platform is pivotably connected to the same vertical beam as an adjacent cover element. A pivotable arrangement of the working platform ensures good and quick access to the area behind the working platform.

In one of the embodiments of first or second aspect, the working platform can be pivoted between a closed position and an open position in which open position access is provided to areas behind the working platform and wherein the pivotal movement of the working platform and that of the adjacent cover element are independent of each other. Thereby it is achieved that full and simultaneous access, i.e. access to the areas behind the working platform and the area covered by the cover elements can be ensured.

In one of the embodiments of first or second aspect, the working platform comprises a door which, in the closed position seals against the sub-frame and/or the frame of the mobile processing device and which, when the working platform is in the open position, provides access to e.g. equipment arranged within the sub-frame and/or the frame of the mobile processing device. Thereby, instant access to the space within the frame and the sub-frame is provided by pivoting the working platform to its open position and instant closing of the space can be achieved by pivoting the working platform to its closed position.

In one of the embodiments of first or second aspect, no part of the noise encapsulation is in direct contact with the material processing unit. Thereby, it is avoided that the encapsulation itself acts as a noise emitter.

In one of the embodiments of first or second aspect, each of the cover elements can be pivoted at least 90° around the respective vertical beam. This ensures full access to the machinery.

In one of the embodiments of first or second aspect, the noise encapsulation can be transported together with the mobile processing device when mounted to the mobile processing device. The compact construction of the noise encapsulation of the present invention makes it possible to transport the mobile processing device with the encapsulation mounted. Prior art solutions sometimes require that the noise encapsulation is transported separately and mounted in situ. This is time consuming and expensive in comparison with the present invention.

In one of the embodiments of first or second aspect, the encapsulation comprises a front wall and the cover elements are arranged to seal with that front wall when the cover elements are in the closed position. This creates an encapsulation having a roof, side walls and a front wall.

In one of the embodiments of first or second aspect, the front wall is arranged between the crusher unit and the power unit. Thereby, it is avoided that the power unit, e.g. a diesel engine, is trapped within the encapsulation where heat and dust would have devastating effects on the power unit.

In one of the embodiments of first or second aspect, the mobile processing device further comprises bottom and rearward sealing to create a complete encapsulation of the material processing unit.

In one of the embodiments of first or second aspect, the encapsulation is made airproof. This is done by providing a complete encapsulation around the material processing unit, e.g. crusher unit or screening unit and using encapsulation elements without any openings. This is possible since there are no significant heat sources inside the encapsulation (e.g. power-unit, drive motors, pumps, etc.). This allows for optimal noise reduction using an encapsulation.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated. As used herein, the term "comprising" and variations of that term are not intended to exclude other additives, components, integers or steps.

DESCRIPTION OF PREFERRED EMBODIMENTS

Figure 1A:
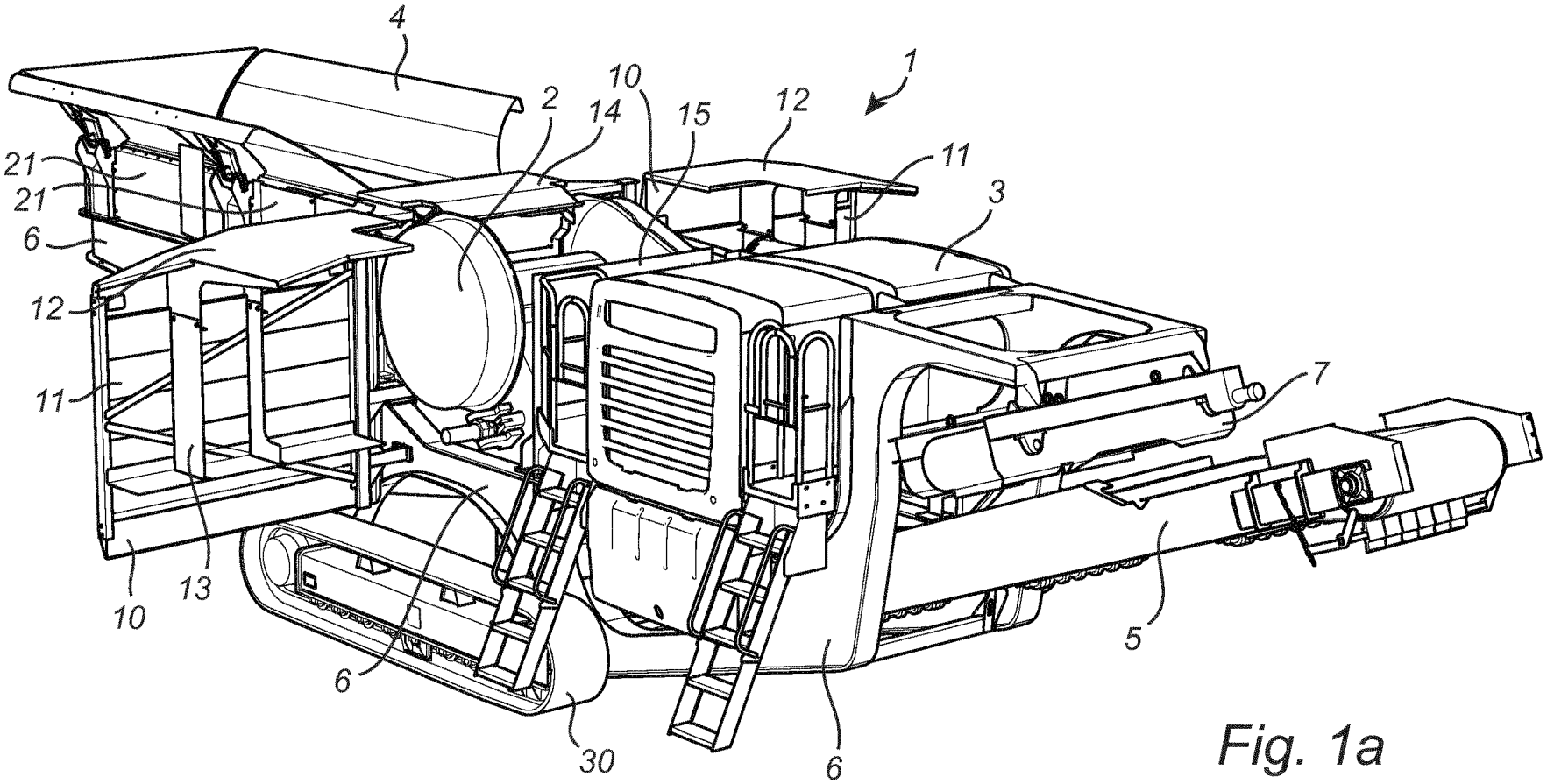
FIG. 1*a* shows a schematic perspective view of an embodiment of the invention with cover elements in an open position.

The present invention will now be described more fully hereinafter with reference to the accompanying drawings, in which currently preferred embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

Figure 1B:
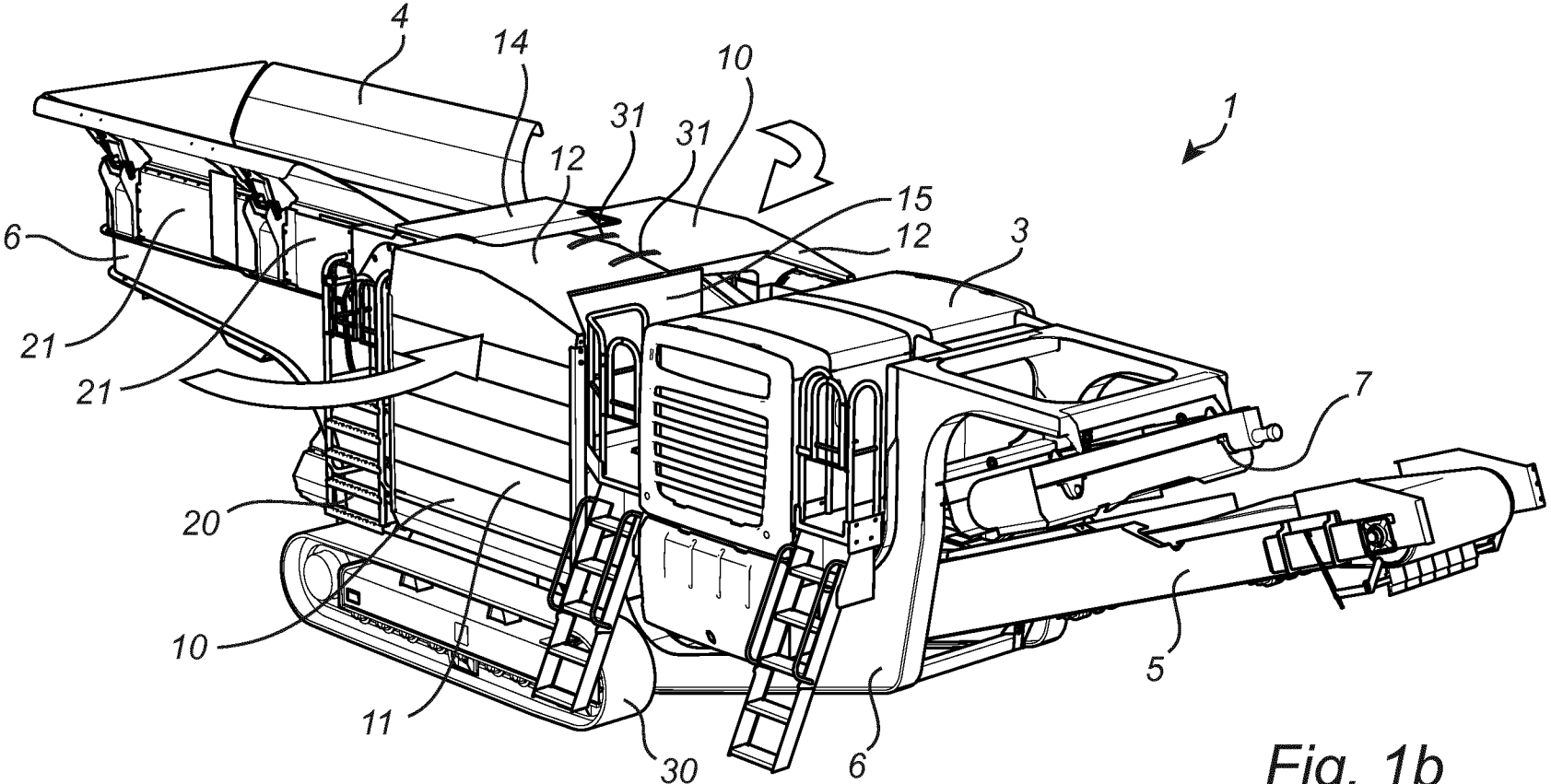
FIG. 1*b* shows a schematic perspective view of an embodiment of the invention with cover elements in a closed position.
Figure 2A:
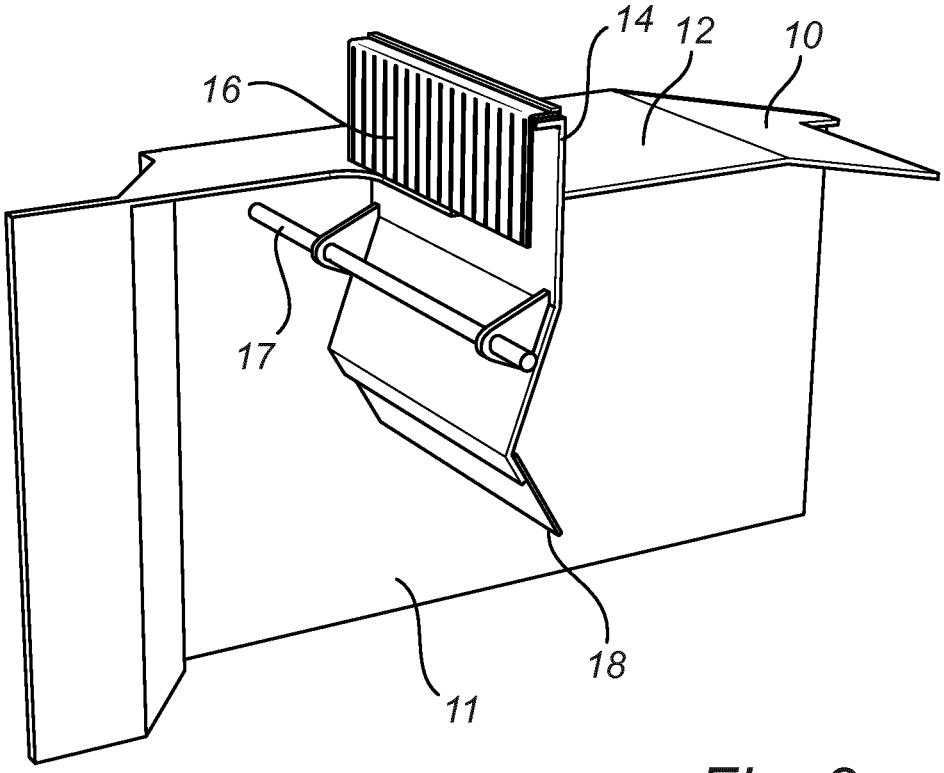
FIGS. 2*a* and 2*b* show schematic perspective views of a detail of an embodiment of the invention.
Figure 2B:
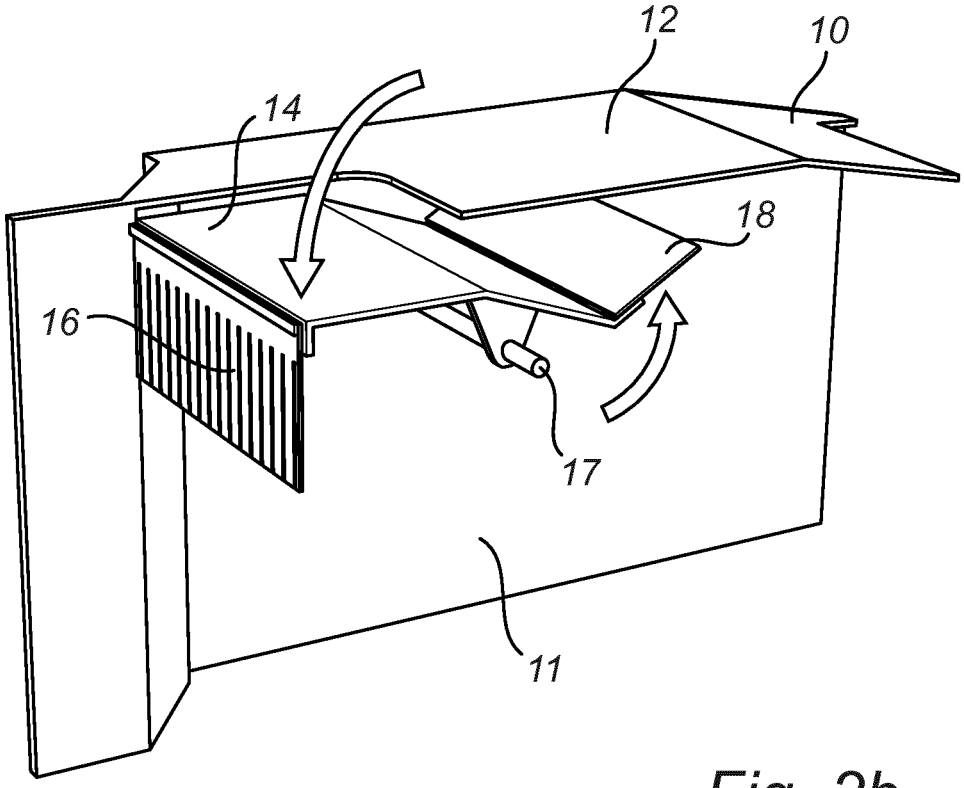

FIGS. 1*a* and 1*b* show a cross-section of an embodiment of the first aspect of the invention, with the noise encapsulation in an open and a closed position respectively. The mobile processing device 1 according to this aspect of the invention comprises a mobile crusher. It should be noted though that the inventive idea of the present invention is also applicable to mobile screens as well. The inventive idea of the present invention is also applicable to mobile crushers having a built in screening unit. Such screening unit is typically arranged between the discharge of the crusher unit and the conveyor. In that case separate encapsulations may be provided for the crusher unit and the screening unit. The mobile crusher 1 comprises a mobile crusher frame 6 forming the basic structure of the mobile crusher onto which the rest of the equipment is mounted. The frame 6 generally comprises two frame beams running in parallel from a rear end to a front end. The mobile crusher 1 further comprises a feed hopper 4 mounted near a rear end of the mobile crusher, a crusher unit 2 and a conveyor 5. A power unit 3 acting as a power plant for the mobile crusher, powering the crusher unit 2, the crawlers 30, the conveyor 5 etc., is mounted towards a front end of the mobile crusher 1. The power unit 3 in this case is a diesel engine but can of course comprise an electric motor or a hydraulic engine or any other suitable power unit. In use, a front loader, excavator or other loader equipment dumps ore, rocks, or other material to be processed in the feed hopper 4 of the mobile crusher 1. The feed hopper may be provided with replaceable rubber lining elements, reducing the impact sound from loading the material. From there, the material is transported, by e.g. vibration, to the crusher cavity of the crusher unit 2. It is possible to have a built in screen in the feed hopper 4 separating e.g. fines from the rest of the material. The fines may for example pass through one or more screens and be transported away from the mobile crusher 1 by means of a separate conveyor without entering the crusher unit 2. The screening and vibration can be provided by vibrating grizzly bars 19, performing both the transportation and the screening. The rest of the material enters the crusher unit 2 and is disintegrated to desired fractions. After that, the disintegrated material leaves the mobile crusher 2 via conveyor 5 and possibly a post-crushing screening unit. A magnetic separator 7 may be provided adjacent to the conveyor 5 to separate ferrous particles from the flow of material. The crusher unit 2 may comprise e.g. a jaw crusher, an impact crusher or a cone crusher. They all have that in common that they produce a large amount of noise during use. Noise that sometimes can be tolerated, for example when the device is used in remote, uninhabited areas. However, when the device is used in urban areas, noise need to be kept to a minimum in order to avoid nuisances to people residing in the area. It has been shown that the crusher unit, e.g. jaw crusher, impact crusher or cone crusher, is contributing with up to 50% of the total noise energy emitted by a mobile crusher. Similar numbers apply for mobile screens. Further, the crusher noise is typically considered to be most disturbing noise source from the environmental point of view. Therefore, noise dampening measures are sometimes required. According to the present invention, two cover elements 10 are provided. They are pivotable around respective vertical beams. The two cover elements 10 each comprise a side wall 11 and a roof part 12 such that when they are opened, unhindered access to the crusher unit 2 is provided, e.g. for maintenance or service work. The cover elements may be made from metal, such as aluminium and/or steel or any other suitable material such as glass fibre or similar materials. Prior art solutions often involve the removal and dismantling of several doors and/or hatches attached to the crusher device by bolts or similar. That is of course very time consuming whereas the solution according to the present invention gives quick, almost instant access to the machinery. All that is required to provide access is to open the quick couplings 31, seen best in FIG. 1*b*, and then the cover elements 10 can be swung open. Quick couplings can be of the type often used on hinged flaps on car trailers. The pivoting movement of the cover elements 10 can be performed by hydraulic actuators or similar. The fact that the cover elements 10 have a size that allows them to cover the entire crusher unit 2 in their closed position also ensures that unhindered access to the crusher unit 2 is ensured when the cover elements 10 are in their open position, as shown in FIG. 1*b*. Side walls 11 and roof parts 12 provide encapsulation in those directions. Surfaces sealing against other surfaces, such as abutting roof surfaces of the cover elements 10, may be provided with rubber elements to enhance sealing properties. If required, encapsulation in a forward direction is provided by means of front wall element 15 which together with front sealing elements 13 of the cover elements 10 ensures that noise dampening dust encapsulation in a forward direction is ensured. Front wall element 15 may for example be made from rubber and will constitute a static encapsulation in front of the crusher unit 2, avoiding pr at least reducing noise radiation. Optimal noise and dust encapsulation is achieved if the crusher unit 2 is encapsulated entirely. In addition to cover elements 10 and front wall element 15, this would require sealing below the crusher unit and in a rearward direction from the crusher unit. This sealing below the crusher unit 2 can be done by applying encapsulation between the two parallel frame beams, e.g. a rubber mat lying on top of the beam members. The sealing behind the crusher unit 2 can be done by additional wall element(s) 21 and/or by using a rubber mat arranged on the frame beams and extending all the way from underneath the crusher unit 2 to the feed hopper 4. Additionally, a crusher cavity cover element 14 can be provided, seen in all figures but best seen in FIGS. 2*a* and 2*b*. Here, a pivotable crusher cavity cover element 14 is illustrated. The crusher cavity cover element 14 can pivoted around a horizontal axis 17 between a closed position in which a sealing element 18 seals against the underside of roof parts 12 of the cover elements 10. The sealing element 18 can comprise a resilient material such as rubber which will provide a good seal against that underside of the roof parts 12. Alternatively, or also, the underside of the roof parts 12 is provided with a deformable and/or resilient material. The other end of crusher cavity cover element 14 is provided with strips 16 of e.g. rubber. These strips 16 will, in the closed position of the crusher cavity cover element 14 be arranged in the flow of material towards the crusher cavity and due to its flexibility, the rubber strips 16 will provide good sealing and noise dampening properties as rocks and similar of different size passes by. A big advantage of this crusher cavity cover element 14 is that it is possible to gain access to the crusher cavity without having to open the cover elements 10. If for example a large piece of rock becomes jammed in the crusher cavity, all that need to be done is to pivot the crusher cavity cover element 14 to its open position and full access is provided. Due to the weight of such crusher cavity cover element 14, the pivoting movement can be performed by e.g. hydraulic actuators or electric motors. It is also conceivable to use a fixed crusher cavity cover element 14. In that case the seal between cover elements 10 and crusher cavity cover element 14 will be provided as cover elements 10 are moved towards their closed position sliding over the tip of sealing element 18 of the crusher cavity cover element 14. It is also possible to combine fixed and pivotable crusher cavity cover elements.

An advantage of the present invention is the fact that the encapsulation is very compact. The encapsulation does at no point add any additional width, height or length to the mobile processing device, or at least only to a very small degree. This means that the fact that an encapsulation is provided, does not imply any limitations as to when and where the mobile processing device can be deployed. Its construction also allows for the mobile processing device to be transported with the encapsulation in place, something that has not been possible with many prior art solutions requiring that the encapsulation be transported separately and mounted in situ.

Figure 3:
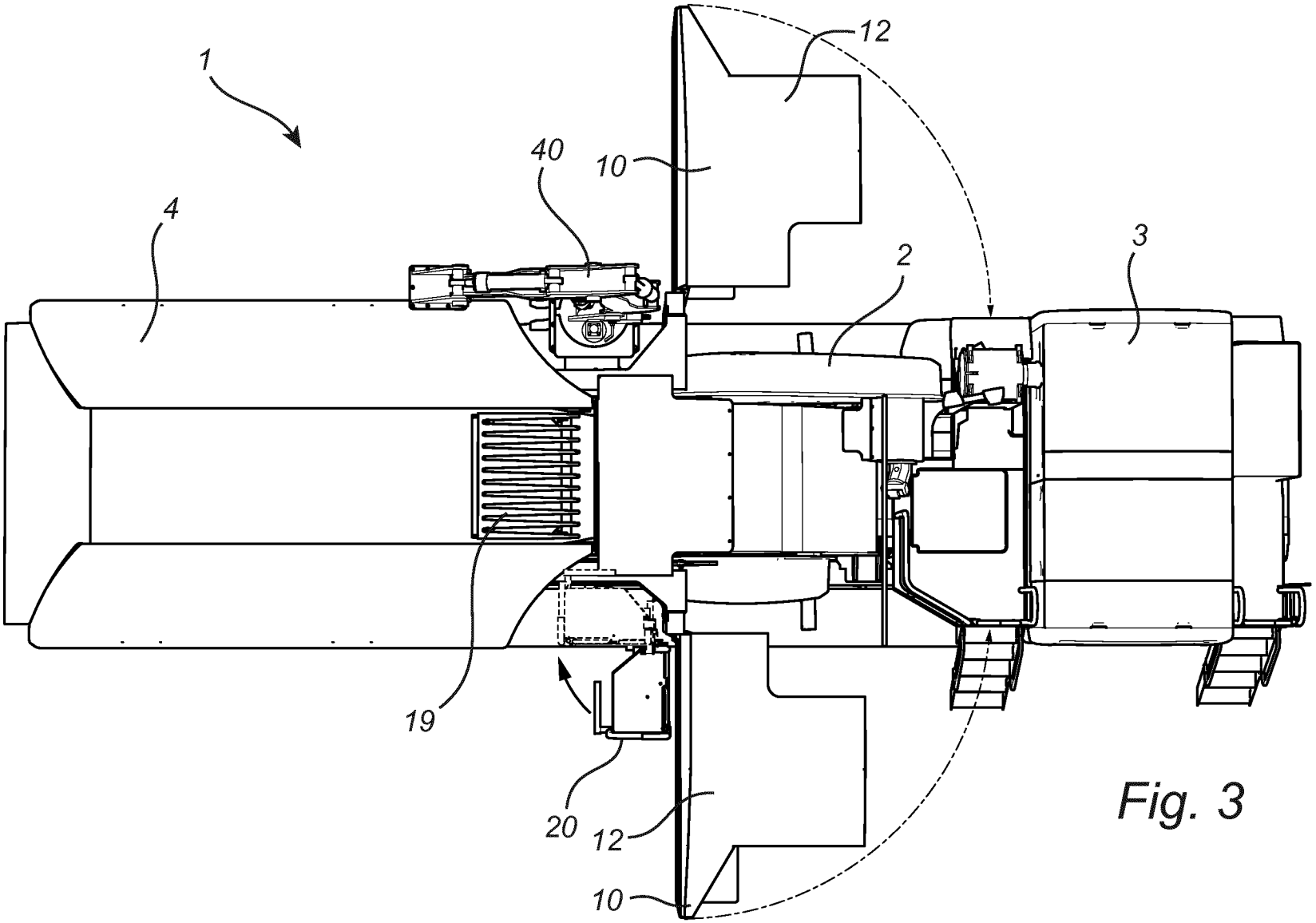
FIG. 3 shows a schematic top view of an embodiment of the invention.

FIG. 4 shows a mobile crusher in a top view of a mobile crusher. Here it can immediately be seen how space efficient the current invention is. This is due to the combination of a narrower sub-frame section, extending from the rear end of the mobile crusher to the vertical beam to which the cover elements 10 are hinged and a wider section extending from the same vertical beam to the front end of the mobile crusher. This allows for a mobile crusher having an encapsulation to have a working platform 20 to be arranged in its normal position, i.e. in the same position as when no encapsulation is provided. Correspondingly, the invention allows for a mobile crusher having an encapsulation to have a hydraulic hammer 40 to be arranged in its normal and preferred position from where it has quick access to both the feed hopper 4 and the crusher cavity of the crusher unit 2. As can be seen in FIG. 3, the working platform 20 is hinged to the same vertical beam as an adjacent cover element 10. The working platform 20 can be pivoted between a closed position (dashed lines in FIG. 3) in which it gives staff access to e.g. the crusher cavity and an open position where it ensures access to areas behind the working platform. It is also possible to integrate a door or hatch into the working platform 20 such that when the working platform 20 is pivoted to its open position, access is immediately provided to space within the frame 6 and/or sub-frame of the encapsulation, e.g. for service or maintenance of any machinery arranged in such space. It is also possible to separate the working platform 20 from any doors or hatches. This has an advantage in that the working platform 20 is sometimes damaged from falling rocks and similar and needs to be replaced. In such case it is preferable not having to replace the door/hatch as well.

The skilled person realizes that a number of modifications of the embodiments described herein are possible without departing from the scope of the invention, which is defined in the appended claims. For example, a mobile processing device according to the invention can instead of running on crawlers run on rails or on bars. Further, it should be noted that with respect to the present invention, the term "encapsulation" does not necessarily mean complete and total enclosing of e.g. the crusher unit. As used herein, the term "encapsulation" can mean both partial and complete enclosing as is apparent from the description, claims and figures. In any case, entrance and exit for the material are required. Acoustic damping materials and/or sound absorbing materials can be provided on the surfaces of the encapsulation, e.g. on the inside of cover elements 10, cavity cover element 14, frame 6 and elements 21 in order to improve noise dampening. The invention enables a compact solution of a noise encapsulation which can be widely opened for maintenance work and which is mounted only to the rigid section of the frame of the mobile processing device. The main idea is to combine wall and roof structures in two large hinged sections that are connected together during operation and opened like doors during the maintenance. The construction also allows a modular solution for different type and size of mobile processing devices. The encapsulation can be made more or less airproof and the small amount of heat that is produced within the encapsulation by e.g. the hydraulic motor driving the vibrating grizzly bars can be used to heat the bottom of the feeder, thus preventing freezing of material to the bottom when loading frozen material to the processing device. A further improvement, possible with the present invention is to integrate the belt cover and the flywheel cover of the crushing unit 2 into the cover elements 10. This provide even faster access to the machinery since they need not be removed in a separate stage.

The invention claimed is:

1. A mobile processing device having a material processing unit; a power unit; a frame; and a noise encapsulation for said material processing unit, wherein the noise encapsulation is attached to the frame and wherein the noise encapsulation comprises two cover elements, each of said cover elements being pivotable between an open position providing access to the material processing unit and a closed position wherein the cover elements can be interconnected to create an encapsulation for the material processing unit, said encapsulation having a roof and side walls, wherein said material processing unit is a mobile crusher having a crusher unit, and wherein it further comprises a crusher cavity cover element, wherein said crusher cavity cover element is pivotable around a horizontal axis between an open position in which access is provided to the crusher cavity and a closed position.

2. A mobile processing device according to claim 1, wherein the two cover elements are hinged at respective vertical beams.

3. A mobile processing device according to claim 2, wherein the vertical beams are parts of a sub-frame.

4. A mobile processing device according to claim 1, wherein each cover element comprises a sidewall and a roof part and wherein, in the closed position, the respective roof parts abut each other and are interconnectable by locking means.

5. A mobile processing device according to claim 1, wherein each cover element has a height such that it covers the height of the material processing unit when the cover elements are in the closed position.

6. A mobile processing device according to claim 1, wherein said crusher cavity cover element comprises a sealing part which, when the crusher cavity cover element is pivoted towards the closed position, seals against the roof of the encapsulation.

7. A mobile processing device according to claim 3, wherein the cover elements are attached to a wider section of the sub-frame and wherein the sub-frame has a narrower section adjoining the wider section.

8. A mobile processing device according to claim 3, wherein parts of the sub-frame section is arranged in a same vertical plane as adjacent parts of the frame of the mobile processing device, wherein the parts of the sub-frame section and the adjacent parts of the frame of the mobile processing device have corresponding shapes and are arranged abutting each other to create a continuous vertical surface.

9. A mobile processing device according to claim 7, wherein a working platform is arranged laterally and outside the narrower sub-frame section and rearwardly of the wider sub-frame section.

10. A mobile processing device according to claim 7, wherein a hydraulic hammer is attached to the frame of the mobile processing device and arranged laterally and outside the narrower sub-frame section and rearwardly of the wider sub-frame section.

11. A mobile processing device according to claim 9, wherein the working platform is pivotably connected to the same vertical beam as a corresponding cover element, wherein the working platform can be pivoted between a closed position and an open position in which open position access is provided to areas behind the working platform and wherein the pivotal movement of the working platform and that of the corresponding cover element are independent of each other.

12. A mobile processing device according to claim 1, comprising a front wall and wherein at least one of the cover elements is arranged to seal with said front wall when the cover elements are in the closed position to create an encapsulation having a roof, side walls and a front wall.

13. A mobile processing device according to claim 1, further comprising bottom and rearward sealing to create a complete encapsulation of the material processing unit.

14. A mobile processing device according to claim 1, further comprising a material screening unit.

* * * * *